US006783333B2

(12) United States Patent
Wang

(10) Patent No.: US 6,783,333 B2
(45) Date of Patent: Aug. 31, 2004

(54) AIR COMPRESSOR

(76) Inventor: Min-Hsieng Wang, P.O. Box 90, Tainan City (TW)

( * ) Notice: Subject to any disclaimer, the term of this patent is extended or adjusted under 35 U.S.C. 154(b) by 80 days.

(21) Appl. No.: 10/342,271

(22) Filed: Jan. 15, 2003

(65) Prior Publication Data

US 2004/0141855 A1 Jul. 22, 2004

(51) Int. Cl.[7] ..... F04B 17/00; F04B 49/00; F04B 23/00; F04B 39/10

(52) U.S. Cl. ..... 417/307; 417/415; 417/63; 417/550; 417/440

(58) Field of Search ..... 417/63, 305, 308, 417/307, 415, 440, 504, 550, 551, 555.1

(56) References Cited

U.S. PATENT DOCUMENTS 3,645,651 A * 2/1972 Bills ..... 417/479
5,655,887 A * 8/1997 Chou ..... 417/63
6,059,542 A * 5/2000 Chou ..... 417/360
6,171,071 B1 * 1/2001 Tzeng et al. ..... 417/279

FOREIGN PATENT DOCUMENTS

WO WO 85/02893 * 7/1985 ..... F16K/17/168

* cited by examiner

*Primary Examiner*—Justine R. Yu
*Assistant Examiner*—Timothy P. Solak

(57) ABSTRACT

An air compressor includes a machine base, a transmission device, a cylinder, a valve, an automatic pressure-releasing valve and a manual pressure-releasing valve. When a pressure gauge indicates that air pressure is excessive, surplus pressure can be released either by the automatic pressure-releasing valve or by the manual pressure-releasing valve, able to protect the components in the air compressor from damaged and ensure safety of a tire receiving compressed air from the air compressor.

1 Claim, 6 Drawing Sheets

AIR COMPRESSOR

BACKGROUND OF THE INVENTION

1. Field of the Invention

This invention relates to an air compressor, particularly to one composed of a machine base, a transmission device, a cylinder, a valve body, an automatic pressure-releasing valve and a manual pressure-releasing valve. The transmission gear of the transmission device is driven by a motor to rotate and actuate a subordinate gear to rotate together with a cam, which, by its eccentric acceleration of gravity, makes a connecting rod and a piston move up and down repeatedly in the cylinder. When the piston rod together with the piston is moved downward, air will get into the cylinder through the air hole of the piston; when the piston is moved upward, air in the cylinder will be compressed to get into the valve body, and then exhaust out of the valve body through an air outlet and be guided by an air duct to be pumped into the tyre, thus the pressure of the exhausted air being very steady. Besides, when the pressure gauge of the air compressor indicates that the air pressure is excessive, surplus pressure can be released by the automatic pressure-releasing valve or by the manual pressure-releasing valve so as to protect the components inside the air compressor from damaged and ensure safety of a tire receiving compressed air from the air compressor.

2. Description of the Prior Art

A conventional air compressor, as shown in FIGS. 1 and 2, includes a motor 10 assembled on a fixing base 11 in the front. A transmission gear 12 is fixed on the shaft of the motor 10, and a subordinate gear 13 is provided on the fixing base 11 and meshed with the transmission gear 12. The subordinate gear 13 has an eccentric shaft 14 connected with a piston rod 15, which has its upper end assembled with a piston 16 positioned in a cylinder 17. The cylinder 17 is secured on the upper portion of the fixing base 11, having an intake valve 18 and an exhaust valve 19. The motor 10 is started to drive the transmission gear 12 to rotate together with the subordinate gear 13, and synchronously the eccentric shaft 14 of the subordinate gear 13 actuates the connecting rod 15 and the piston 16 to move up and down in the cylinder 17. When the piston 16 is moved downward, external air will be sucked into the cylinder 17 through the intake valve 18, but when the piston 16 is moved upward, air in the cylinder 17 will be compressed to get out of the exhaust valve 19.

However, the subordinate gear 13 of the conventional air compressor is directly rotated by the transmission gear 12, therefore the moving distance of the piston rod 15 is comparatively short and consequently its driving force is comparatively small, unable to suck in and exhaust out a large quantity of air. Besides, the conventional air compressor provides with no manual pressure-releasing valve to release surplus pressure from the interior of the compressor, possible to damage the components inside the compressor.

SUMMARY OF THE INVENTION

The objective of the invention is to offer an air compressor provided with an automatic pressure-releasing valve and a manual pressure-releasing valve, able to automatically or manually release surplus pressure from the interior of the compressor to ensure safety of a tyre.

The air compressor in the present invention includes a machine base having a chamber formed inside and a through opening bored in the topside and communicating with the chamber, the machine base is further provided in one side with a vertical opening defined by two opposite side walls respectively bored with a shaft hole having a recess formed outside for receiving a bearing, with a through hole bored above the cut groove, the machine base fixed thereon with a motor seat having a shaft hole. The air compressor also has a transmission device composed of a motor, a transmission gear, a subordinate gear, a cam, an eccentric shaft, a piston rod, a piston, a covering member, a piston air ring and a gasket. The motor is assembled on the motor seat of the machine base, with the transmission gear secured on the shaft of the motor and positioned in the through hole of the machine base. The subordinate gear is inserted by a transmission shaft and positioned in the cut groove of the machine base to mesh with the transmission gear. The cam is fitted on one end of the transmission shaft and having a shaft hole in the center, and an insert hole bored under the shaft hole and fixed therein with an eccentric shaft. The piston rod is provided with an accommodating hole at the bottom for receiving a bearing, which is secured on the eccentric shaft, the piston assembled on the upper end of the connecting rod and having an air hole in the center, with the cover fastened on the piston and having a C-shaped hole formed therebetween with a openable stop sheet for covering the air hole of the piston. The gasket is fitted in the piston air ring and together disposed on the piston, and a cylinder is fixedly assembled on the machine base and having an air hole in the topside, with a valve combined on the cylinder and having a vertical air passage passing through its bottom side, and a lower side provided with a connecter for connecting a pressure gauge and the other lower side provided with an automatic pressure-releasing holder and an air outlet. The valve is further provided with a manual pressure-releasing holder at an upper portion, with an automatic pressure-releasing valve fitted in the automatic pressure-releasing holder of the valve body and composed of a stuffing member, a spring and a regulating member. A manual pressure-releasing valve is fitted in the manual pressure-releasing holder of the valve body and composed of a stuffing member, a spring, a push needle and a fixing cap.

BRIEF DESCRIPTION OF DRAWINGS

This invention will be better understood by referring to the accompanying drawings, wherein.

DETAILED DESCRIPTION OF THE PREFERRED EMBODIMENTS

Figure 2:
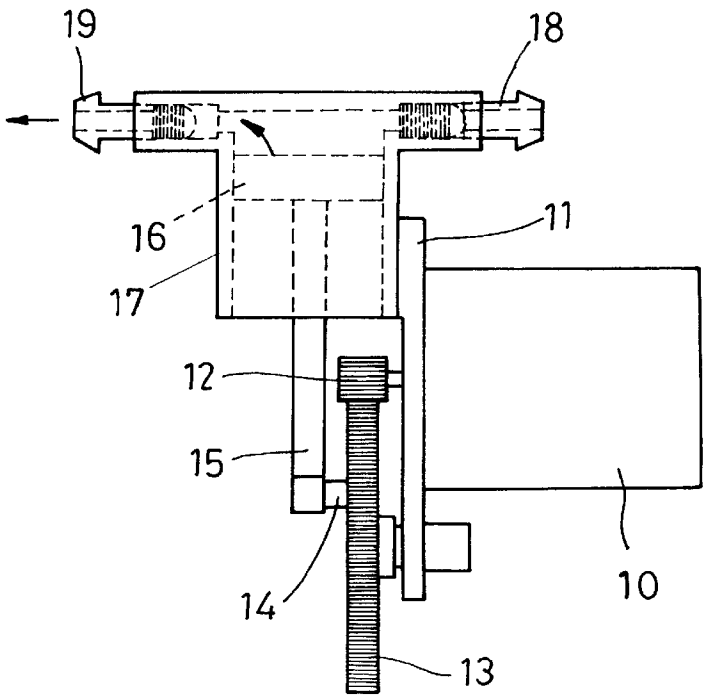
FIG.2 (PRIOR ART)
FIG. 2 is a cross-sectional view of the conventional air compressor, indicating air compressed and exhausted out of the cylinder.
Figure 1:
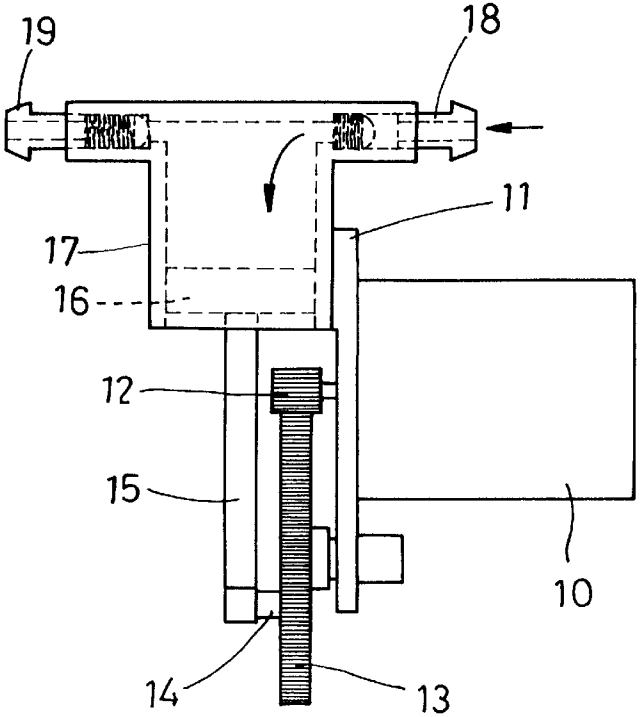
FIG.1 (PRIOR ART)
FIG. 1 is a cross-sectional view of a conventional air compressor, indicating air sucked into a cylinder.
Figure 3:
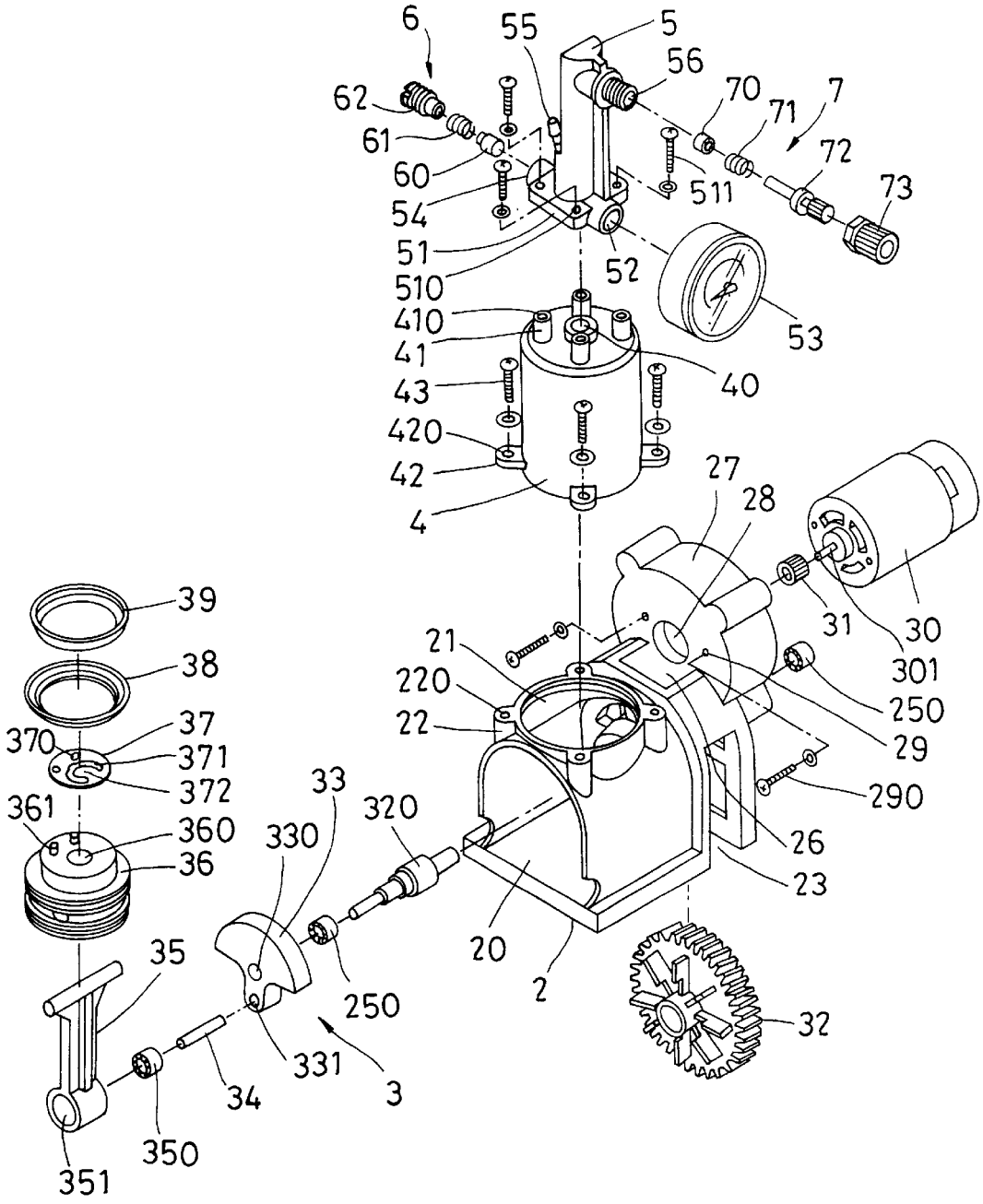
FIG. 3 is an exploded perspective view of an air compressor in the present invention.
Figure 4:
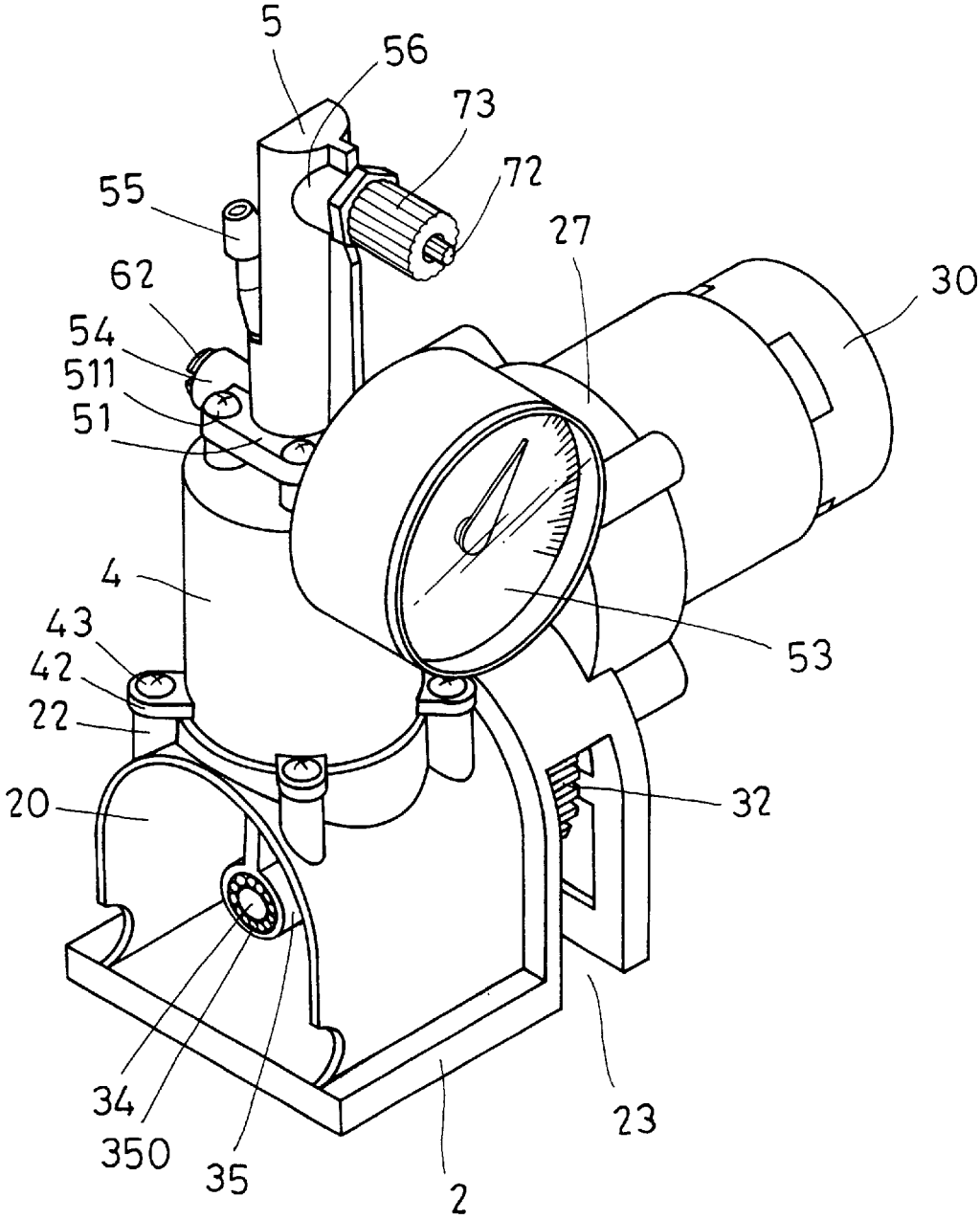
FIG. 4 is a perspective view of the air compressor in the present invention.

A preferred embodiment of an air compressor in the present invention, as shown in FIGS. 3 and 4, includes a machine base 2, a transmission device 3, a cylinder 4, a valve body 5, an automatic pressure-releasing valve 6 and a manual pressure-releasing valve 7 as main components combined together.

The machine base 2 has a chamber 20 formed in the interior, a through opening 21 bored in the topside to communicate with the chamber 20 and a plurality of fixing studs 22 provided around the outer circumference of the through opening 21 and respectively having a threaded hole 220. The machine base 2 is further provided at one side with a vertical opening 23 defined by two opposite side walls respectively formed with a shaft hole 24, with a recess 25 provided at the outer side of each shaft hole 24 for receiving a bearing 250 therein. A motor seat 27 is secured on one upper side of the machine base 2, having a horizontal shaft hole 28 formed inside and two fixing holes 29 respectively bored at the opposite sides of the shaft hole 28 for bolts 290 to be inserted therethrough.

The transmission device 3 is composed of a motor 30, a transmission gear 31, a subordinate gear 32, a cam 33, an eccentric shaft 34, a piston rod 35, a piston 36, a cover 37, a piston air ring 38 and a gasket 39. The motor 30 is fixedly assembled on the motor seat 27 of the machine base 2 by the bolts 290. The transmission gear 31 is fixed on the shaft 301 of the motor 30 and positioned in the through hole 26 of the machine base 2. The subordinate gear 32 is inserted by a transmission shaft 320 and received in the vertical opening 23 of the machine base 2 meshing with the transmission gear 31. The cam 33 is secured on one end of the transmission shaft 320 and received in the chamber 20 of the machine base 2. The cam 33 has a shaft hole 330 in the center and an insert hole 331 under the shaft hole 330 for an eccentric shaft 34 to be fixed therein. The piston rod 35 is bored with an accommodating hole 351 at the lower end for receiving a bearing 350, which is fixed on the eccentric shaft 34. The piston 36 assembled on the piston rod 35 is provided at the topside with an air hole 360 and two studs 361. The cover 37 disposed on the piston 36 is bored in the topside with two insert holes 370 and a C-shaped hole 371 having a stop sheet 372 defined by the C-shaped hole 371 for covering the air hole 360 of the piston 36. The piston air ring 38 is fixed on the upper side of the piston 36 for the gasket 39 to be fitted therein.

The cylinder 4 is fixedly assembled on the machine base 2, having its topside bored with an air hole 40 and provided with a plurality of studs 41 respectively having a threaded hole 410. Besides, the cylinder 4 has its bottom side provided with a plurality of fixing members 42 respectively having an insert hole 420 for bolts 43 to be respectively inserted therethrough and secure the cylinder 4 on the machine base 2.

The valve 5 assembled on the cylinder 4 is formed inside with a vertical air passage 50 passing through the bottom side, provided at the bottom with a fixing base 51 having plural insert holes 510 for bolts 511 to be respectively inserted therethrough and secure the valve 5 on the cylinder 4. Further, the valve 5 is provided with a connector 52 at one side near the bottom for connecting a pressure gauge 53 and an automatic pressure-releasing holder 54 with an air outlet at the other side. In addition, the valve 5 has a manual pressure-releasing holder 56 provided on one upper side.

The automatic pressure-releasing valve 6 received in the automatic pressure-releasing holder 54 is composed of a stuffing member 60, a spring 61 and a regulating member 62.

The manual pressure-releasing valve 7 received in the manual pressure-releasing holder 56 is composed of a stuffing member 70, a spring 71, a push needle 72 and a fixing cap 73.

Figure 5:
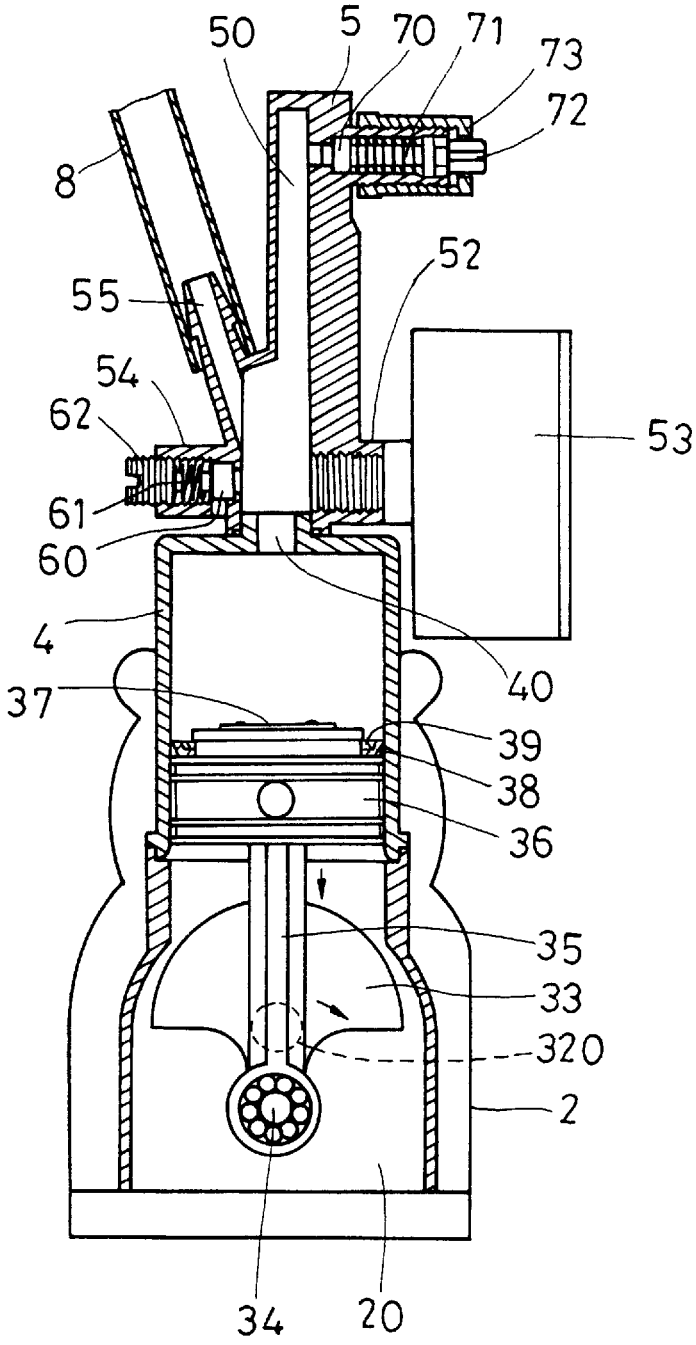
FIG. 5 is a lengthwise cross-sectional view of the air compressor in the present invention.

In assembling, as shown in FIGS. 3, 4 and 5, firstly, the subordinate gear 32 is received in the vertical opening 23 of the machine base 2, and the transmission shaft 320 is inserted through both the shaft hole 24 of the machine base 2 and the subordinate gear 32, and then the two bearings 250 are respectively received in the two recesses 25 of the machine base 2 and fitted on the opposite ends of the transmission shaft 320. Next, the transmission gear 31 is fixed on the shaft 301 of the motor 30, which is then installed on the motor seat 27, letting the transmission gear 31 located in the through hole 26 of the machine base 2 and meshed with subordinate gear 32. Then, the cam 33 is received in the chamber 20 of the machine base 2 and fixed on the transmission shaft 320, and the bearing 350 is fitted in the accommodating hole 351 of the piston rod 35 and the eccentric shaft 34 is inserted through both the insert hole 331 of the cam 33 and the bearing 350 in the accommodating hole 351 of the piston rod 35, letting the lower end of the piston rod 35 connected with one side of the cam 33 and the upper end extend out of the through opening 21 of the machine base 2. Afterward, the piston 36 is assembled on the topside of the connecting rod 35, and the cover 37 is fixed on the piston 36, with the piston air ring 38 together with the gasket 39 secured on the upper side of the piston 36. Then, the piston 36 is received in the cylinder 4, which is subsequently secured on the machine base 2 by the means of bolts 43. Lastly, the stuffing member 60, the spring 61 and the regulating member 62 of the automatic pressure-releasing valve 6 are orderly fitted in the automatic pressure-releasing holder 54 of the valve 5, and the stuffing member 70, the spring 71, the push needle 72 and the fixing sleeve 73 of the manual pressure-releasing valve 7 are orderly fitted in the manual pressure-releasing holder 56. Then the pressure gauge 53 is combined with the connector 52 of the valve 5, thus finishing the assembly of the air compressor.

Figure 6:
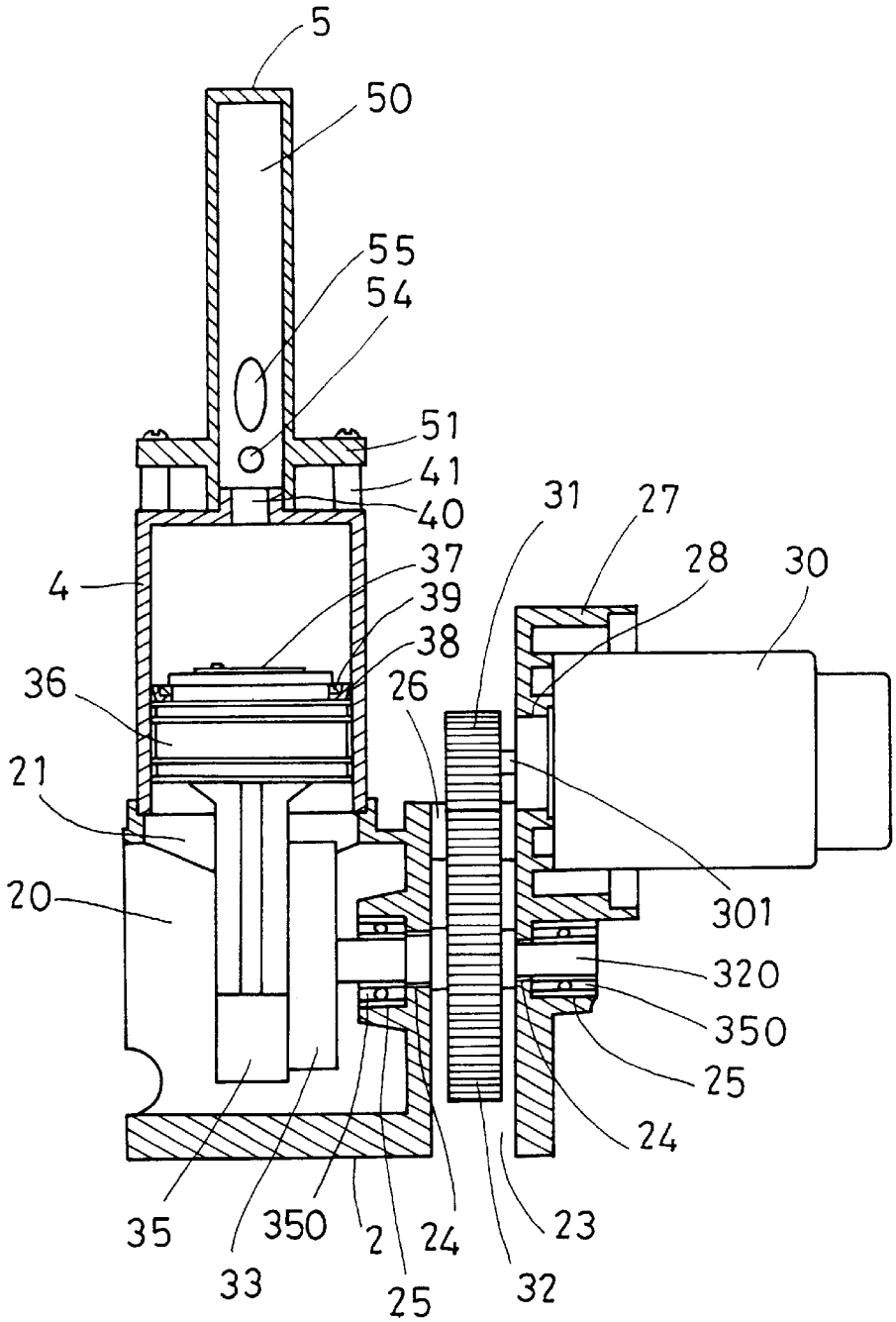
FIG. 6 is a lateral cross-sectional view of the air compressor in the present invention; and, FIG. 7 is a lengthwise side cross-sectional view of the air compressor in the present invention, indicating the piston moved upward.
Figure 7:
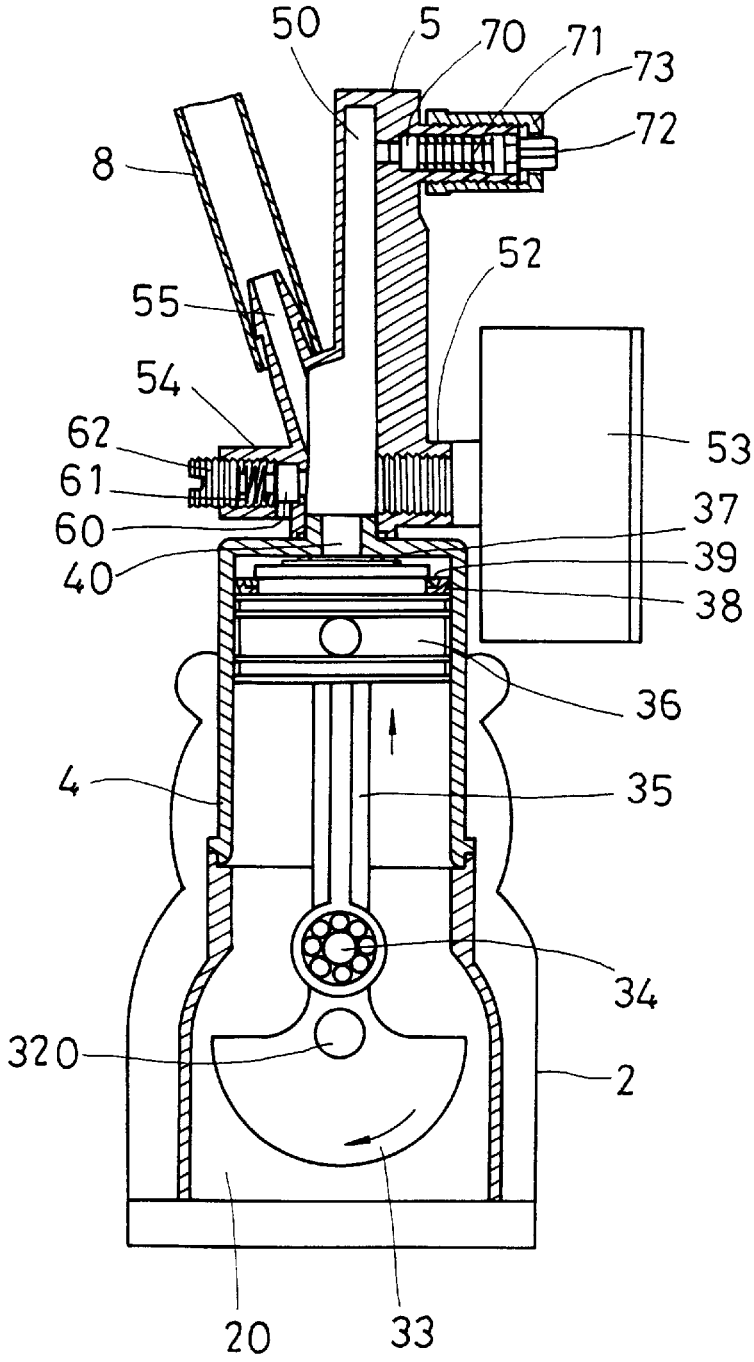

In using, as shown in FIGS. 6 and 7, the motor 30 is started to drive the transmission gear 31 to rotate together with the subordinate gear 32, with the transmission shaft 320 of the subordinate gear 32 actuated to rotate the cam 33, which, by its eccentric acceleration of gravity, will make the piston rod 35 together with the piston to move up and down repeatedly in the cylinder 4. Thus, when the piston 36 is moved down, air will slightly push up the stop sheet 372 of the cover 37 through the air hole 360 of the piston 36 and get into the cylinder 4. On the contrary, when the piston 36 is moved up, air in the cylinder 4 will be compressed to get into the valve 5 through the air hole 40 of the cylinder 4 and then exhaust out of the valve body 5 through the air outlet 55 and be guided by an air duct 8 to be pumped into a tyre. By so designing, the pressure of the air exhausted is quite stable. Besides, when the pressure gauge 53 indicates that the air pressure is excessive, surplus pressure can be automatically released by the automatic pressure-releasing valve 6 or be manually released by the manual pressure-releasing valve 7 in case the automatic pressure-releasing valve 6 fails to carry out pressure releasing, able to protect the components in the air compressor from damaged and also ensure safety of the tyre.

While the preferred embodiment of the invention has been described above, it will be recognized and understood that various modifications may be made therein and the appended claims are intended to cover all such modifications that may fall within the spirit and scope of the invention.

What is claimed is:

1. An air compressor comprising:

a machine base formed with a chamber in the interior, said machine base bored in a topside with a through opening communicating with said chamber, said machine base formed with a vertical opening at one side, said vertical opening defined by two opposite side walls respectively bored with a shaft hole, each said shaft hole having its outer side provided with a recess for receiving a bearing therein, a through hole bored above said vertical opening, a motor seat fixed on one upper side of said machine base, said motor seat bored with a shaft hole;

a transmission device composed of a motor, a transmission gear, a subordinate gear, a cam, an eccentric shaft, a piston rod, a piston, a cover, a piston air ring and a gasket, said motor fixed on said motor seat of said machine base, said transmission gear fixed on a shaft of said motor and positioned in said through hole of said machine base, said subordinate gear inserted by a transmission shaft and received in said vertical opening of said machine base, said subordinate gear meshed with said transmission gear, said cam secured on one end of said transmission shaft, said cam having a shaft hole in the center and an insert hole under said shaft hole, said insert hole of said cam fixed therein with an eccentric shaft, said piston rod provided with an accommodating hole for receiving a bearing, said bearing fixedly fitted on said eccentric shaft, said piston assembled on said connecting rod and having an air hole in the center, said covering member disposed on said piston and having a C-shaped through hole, said C-shaped hole defining a stop sheet for covering said air hole of said piston, said gasket received in said piston air ring which is fixed on the upper side of said piston;

a cylinder secured on said machine base and having an air hole in its topside;

a valve firmly assembled on said cylinder, said valve formed inside with a vertical air passage passing through its bottom side, said valve provided with a connector at one bottom side for connecting a pressure gauge and with an automatic pressure-releasing holder and an air outlet at the other bottom side, said valve further provided with a manual pressure-releasing holder at an upper portion;

an automatic pressure-releasing valve fitted in said automatic pressure-releasing holder of said valve, said automatic pressure-releasing valve composed of a stuffing member, a spring and a regulating member; and, a manual pressure-releasing valve disposed in said manual pressure-releasing holder of said valve, said manual pressure-releasing valve composed of a stuffing member, a spring, a push needle and a fixing sleeve.

* * * * *